US005297297A

United States Patent [19]

Pei

[11] Patent Number: 5,297,297

[45] Date of Patent: Mar. 29, 1994

[54] AUTOMATIC VISOR CONTROL DEVICE FOR HELMETS

[76] Inventor: Pei-Hsin Pei, P.O. Box 10780, Taipei, Taiwan

[21] Appl. No.: 41,864

[22] Filed: Apr. 2, 1993

[51] Int. Cl.[5] ..... A42B 3/02

[52] U.S. Cl. ..... 2/424; 2/8

[58] Field of Search ..... 2/424, 425, 8, 9, 10, 2/422, 6, 410

[56] References Cited

U.S. PATENT DOCUMENTS 4,546,498 10/1985 Fantin ..... 2/8 X 4,875,235 10/1989 Kuhlman ..... 2/8

4,916,753 4/1990 Khacdung ..... 2/8

*Primary Examiner*—Peter Nerbun

[57] ABSTRACT

An automatic visor control device for a helmet including a movable visor pivotally fixed onto either side of the helmet and covering a window opening in the front side of the helmet, a power device disposed on one side of the helmet, and a wind-pressure switch provided in the lower portion of the front side of the helmet. By means of the wearer's blowing, the power device is activated to cause the visor to move up or down.

2 Claims, 2 Drawing Sheets

AUTOMATIC VISOR CONTROL DEVICE FOR HELMETS

FIELD OF THE INVENTION

The present invention relates generally to an automatic visor control device for helmets, and particularly a device which makes use of a wind-pressure switch to open or close the visor of a helmet.

BACKGROUND OF THE INVENTION

Most known helmets are usually provided with a transparent visor to prevent the entry of dust or dirty particles and cold wind, and which covers the window opening in the central region of the front side of the helmet. The two end portions of the visor are pivotally disposed on either sides of the helmet near the wearer's ears. As is commonly known, the wearer often needs to lift up the visor to get some fresh air, especially during hot summer days or traffic jams or when waiting for the change of traffic lights at road junctures. Once the traffic gets moving, the wearer pulls down the visor and starts on the road again. This repetitious lifting up or pulling down of the visor is very troublesome.

Moreover, designs of conventional helmets require the use of the hand to move up or down the visor. Even though there is also a kind of helmet provided with a push button switch on the helmet body to manipulate the visor, it still requires manual operation; improvement thereon is therefore necessary.

SUMMARY OF THE INVENTION

The primary object of the present invention is to provide an automatic visor control device for a helmet, wherein the need of manual operation is eliminated.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
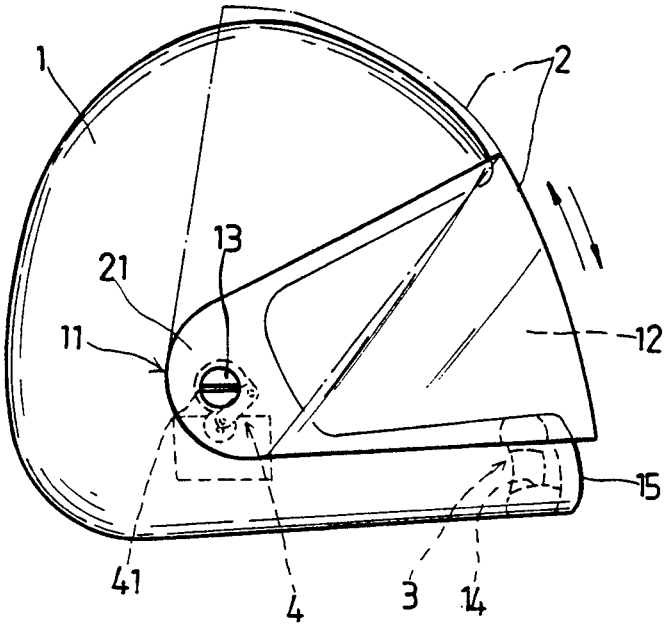
FIG. 1 is a plan view of a preferred embodiment of the present invention, showing one side of the helmet.

With reference to FIG. 1, the present invention comprises a helmet 1, having two pivot seats 11 (the figure shows only one pivot seat) disposed on either side of the helmet 1 near the wearer's ear region, an opening 12 in the upper central portion of the front side of the helmet 1, and a pair of pivot pins 13 (the figure shows only one of them), each being disposed on the corresponding pivot seat 11; by means of the pivot seats 11 and the pivot pins 13, two elements 21 at the end of the visor 2 are each pivotally fixed onto the helmet 1 so that the visor 2 may cover the opening 12.

The present invention is characterized in that an installation hole 14 is provided in the lower portion 15 below the central portion of the front side of the helmet

1 for the accommodation of a wind-pressure switch 3 so that the wind-pressure switch 3 is substantially located in a position in front of the wearer's mouth.

The present invention is also characterized in that a power device 4 is disposed on one of the pivot seats 11 on the helmet 1. The power device, as illustrated in FIGS. 3 and 4, has a rotary plate 41 which is pivotally provided on the pivot pin 13 and capable of partial circumferential movement, and other action elements (to be described hereinafter).

Figure 5:
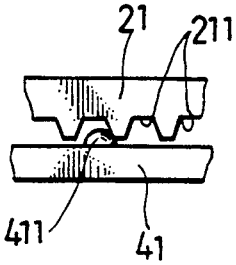
FIG. 5 is partial structural top view, showing the visor and the rotary plate of the present invention in an engaged state.

The rotary plate 41 and one of the elements 21 at an end of visor 2 are engaged together in the manner shown in FIG. 5, wherein annular continuous notches 211 on the element 21 engage with a nose 411 on the rotary plate 41, thereby when the rotary plate 41 turns, the visor 2 is caused to turn simultaneously. Both the continuous notches 211 and the nose 411 are suitably flexible so that when the visor 2 is deliberately moved by hand, the continuous notches 211 and the nose 411 will generate relative sliding movement (to be described hereinafter). It is also obvious that the nose 411 may be disposed on the element 21 of the visor 2, while the continuous notches 211 may be provided on the rotary plate 41. The effect achieved is still the same; that is, when the power device 4 activates the rotary plate 41 (to be hereinafter described), the visor 2 is simultaneously brought to move up or down, and when the power device 4 fails or runs out of power, the wearer may still control the visor 2 by pushing up or pulling down since the nose 411 may slide past each of the continuous notches 211 to allow the movement of the visor 2.

Figure 3:
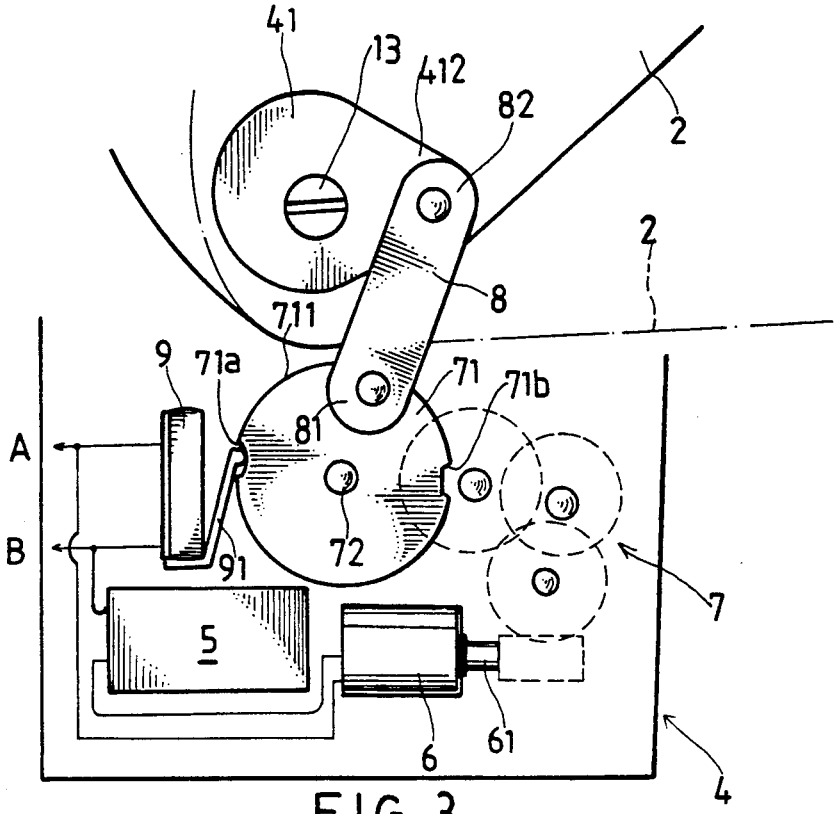
FIG. 3 is a detailed structural plan view of the preferred embodiment of the present invention.
Figure 4:
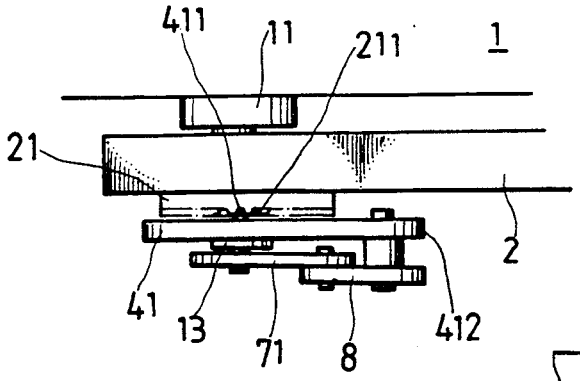
FIG. 4 is a top view of FIG. 3.

As shown in FIG. 3, the above-mentioned power device 4 further comprises a battery device 5, connected to a motor 6 having an output shaft 61, and a decelerating device 7 driven by the output shaft 61; the output end 72 of the decelerating device 7 has fixed thereon a cam ring 71 which has a circumference 711 and at least two action elements for activating a limit switch 9. These so-called action elements shown in FIG. 3 are formed of notches 71*a*, 71*b* in the circumference 711 of the cam ring 71. Certainly, these elements may also be formed in other ways.

The above-mentioned power device 4 further comprises a link 8, the first end 81 thereof is pivotally disposed on the circumference 711 of the cam ring 71, with the second end 82 thereof pivotally disposed on an application end 412 of the rotary plate 41.

The above-mentioned limit switch 9 has a switch element 91 which is in contact with either of the action elements, i.e., the notches 71*a* and 72*b*, of the cam ring 71 to generate movement. The limit switch 9 is connected in series to the battery device 5 and the motor 6; that is, the first pole A and second pole B of the limit switch 9 are respectively connected to the battery device 5 and the motor 6.

When the wind-pressure switch 3 becomes closed due to the wearer's blowing (to be described hereinafter), current flows from the battery device 5 to the motor 6 so that the motor 6 starts rotation, bringing the cam ring 71 to turn therewith, thereby causing the switch element 91 of the limit switch 9 to touch the circumference 711 of the cam ring 71 so that the limit switch 9 becomes closed to enable the battery device 5 to continue supplying power to the motor 6, until the switch element 91 of the limit switch 9 touches one of the notches, such as notch 71*a*, of the cam ring 71, then the passage of current from the battery device 5 to the motor 6 is cut off. When the above-mentioned wind-pressure switch 3 is blown against again and the motor is thereby activated, the switch element 91 again touches the circumference 711 of the cam ring 71 and the limit switch 9 becomes closed again, causing the battery device 5 to continue supplying power to the motor 6, and by means of the cam ring 71 which pushes the link 8, the rotary plate 41 is caused to swing, with the pivot pin 13 as the center, causing the visor 2 to automatically swing in a counter-direction, as shown by the imaginary line. This method of using the distance between the notches 71*a* and 71*b* on the circumference 711 to achieve the effect of time delay can prevent the visor 2 from turning due to abrupt blowing, sudden currents of air, or shaking.

Figure 2:
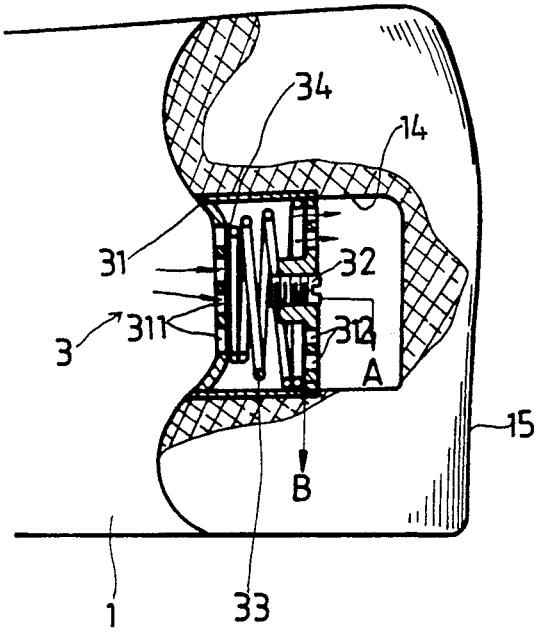
FIG. 2 is a partially enlarged sectional view of the wind-pressure switch of the present invention.

The wind-pressure switch 3 is connected in parallel to the limit switch 9 and may have various embodiments. FIG. 2 shows only one of these possible embodiments; their common feature is that wind pressure is created by the wearer's deliberate blowing against the wind-pressure switch 3 to cause the flow of current from the battery device 5 to the motor 6.

As shown in FIG. 2, the wind-pressure switch 3 comprises a seat body 31, having a multiplicity of air inlets in the front thereof and a multiplicity of air outlets at the back thereof. The surface of distribution of the air inlets is preferably concave.

At the central base region of the seat body 31 is provided an adjusting contact point 32, connected to the first pole A of the above-mentioned limit switch 9; the second pole B of the limit switch 9 is connected to the base of a volute spring 33 located in the central region of the wind-pressure switch 3. A conductive sheet 34 is fixed onto the free end of the volute spring 33 and faces the air inlets 311. When the air inlets 311 are blown against, the conductive sheet 34 is caused to move to the right, so that it touches the adjusting contact point 32, the wind-pressure switch 3 then becomes closed; the path from the battery device 5 to the motor 6 is thereby connected, causing the motor 6 to start rotation and to bring the cam ring 71 to turn therewith.

The present invention eliminates the need to lift up or pull down the visor, thus preventing possible accidents caused by manipulating the visor while the wearer is on the road. Moreover, the present invention consumes little energy, and both the wind-pressure switch and power device are very small, so that helmets according to the present invention are not much different from conventional helmets in terms of weight and size. The present invention, therefore, provides a higher degree of safety and facility than prior art.

In addition, the present invention may also be applied to toys to constitute toy helmets wherein the visor may be controlled by blowing air against the wind-pressure switch. Therefore, the scope of protection should not be restricted to helmets for motorcyclists and the like but should also extend to toy helmets for children.

Although the present invention has been illustrated and described with reference to the preferred embodiments thereof, it should be understood that it is in no way limited to the details of such embodiments, but is capable of numerous modifications within the scope of the appended claims.

What is claimed is:

1. An automatic visor control device for helmets, said device comprises:

a helmet having a pair of pivot seats provided on either side of said helmet near the wearer's ear region, a pair of pivot pins each provided on the corresponding pivot seat, an opening in the upper central portion of the front side of said helmet, and installation hole provided in the lower portion of the front side of said helmet, a movable visor covering said opening, two elements at both ends thereof being pivotally fixed on said pivot seats by means of said pivot pins;

a wind-pressure switch fixed inside said installation hole; and a power device disposed on one side of said helmet near the wearer's ear region, said power device having a rotary plate with an application end, said rotary plate being pivotally provided on one of said pivot pins and engaging with one of said elements at one end of said visor by means of annular continuous notches and a nose portion formed on one of said elements and said rotary plate, respectively, so that said visor may perform partial rotation with said rotary plate simultaneously; a battery device; a motor connected to said battery device and having an output shaft; a decelerating device driven by said output shaft of said motor and having an output end with a cam ring fixed thereon, said cam ring having a circumference and at least two action elements formed on said circumference; a link, the first end thereof being pivotally provided on said cam ring, with the other end thereof pivotally provided on said application end of said rotary plate; and a limit switch having a switch element and connected in series to said battery device and said motor, said limit switch being connected in parallel to said wind-pressure switch and said switch element alternately touching either said circumference of said cam ring or one of said action elements of said cam ring; wherein when said wind-pressure switch is blown against to become closed, the path from said battery device to said motor is connected, causing said motor to rotate, and by means of said circumference of said cam ring, said limit switch is caused to become closed so that said motor continues to receive power supply from said battery device and keeps on rotating until one of said action elements of said cam ring activates said switch element of said limit switch, thereby cutting off power supply to said motor.

2. An automatic visor control device for helmets as claimed in claim 1, wherein said wind-pressure switch comprises a seat body having a multiplicity of air inlets and a multiplicity of air outlets; an adjusting contact point provided on the central base region of said seat body, said adjusting contact point being connected to the first pole of said limit switch; a volute spring having a base and a free end, said base of said volute spring being fixed onto said seat body and connected to the second pole of said limit switch; and a conductive sheet fixed to said free end of said volute spring and facing said air inlets.

* * * * *